US009871314B2

(12) United States Patent
Wang

(10) Patent No.: US 9,871,314 B2
(45) Date of Patent: Jan. 16, 2018

(54) POWER CONNECTOR HAVING A DUAL-BEAM CONTACT

(71) Applicant: FOXCONN INTERCONNECT TECHNOLOGY LIMITED, Grand Cayman (KY)

(72) Inventor: Cai-Yuan Wang, HuaiAn (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 15/386,309

(22) Filed: Dec. 21, 2016

(65) Prior Publication Data

US 2017/0179630 A1 Jun. 22, 2017

(30) Foreign Application Priority Data

Dec. 21, 2015 (CN) ..... 2015 2 1066914 U

(51) Int. Cl.
*H01R 13/24* (2006.01)

(52) U.S. Cl.
CPC ..... *H01R 13/2428* (2013.01)

(58) Field of Classification Search
CPC ..... H01R 13/2428
USPC ..... 439/700, 824
See application file for complete search history.

(56) References Cited

U.S. PATENT DOCUMENTS 4,773,877 A 9/1988 Krueger Gustav
5,807,123 A * 9/1998 Spiegelaar ..... H01R 13/05 439/136
6,068,519 A * 5/2000 Lok ..... H01R 13/2442 439/660
6,083,059 A * 7/2000 Kuan ..... H01R 13/2428 439/482
6,113,440 A * 9/2000 Fijten ..... H01R 13/2442 439/862
6,315,621 B1 * 11/2001 Natori ..... H01R 13/2428 439/862
6,361,359 B1 * 3/2002 Du ..... H01M 2/1022 429/97
6,540,567 B1 * 4/2003 Yeh ..... H01R 13/2442 439/701
6,685,512 B2 2/2004 Ooya
6,695,628 B2 * 2/2004 Yeh ..... H01R 13/2442 439/500
6,702,621 B2 * 3/2004 Yeh ..... H01R 13/2442 439/660

(Continued)

FOREIGN PATENT DOCUMENTS

CN 204696297 10/2015

*Primary Examiner* — Ross Gushi
(74) *Attorney, Agent, or Firm* — Wei Te Chung; Ming Chieh Chang

(57) ABSTRACT

A power connector includes: an insulative housing including an upper surface, a lower surface, and a receiving space; a number of contacts accommodated in the insulative housing each including a contacting portion, a rear portion accommodated in a rear end of the insulative housing, and a corrugated elastic portion connecting the contacting portion and the rear portion, the contacting portion including a lower tongue plate extending forwardly from the corrugated elastic portion, an upper tongue plate, and a curved section connecting the lower tongue plate and the upper tongue plate; wherein the curved section has a pair of contact beams.

16 Claims, 9 Drawing Sheets

(56) References Cited

U.S. PATENT DOCUMENTS 6,814,626 B2 * 11/2004 Wen-Yao ..... H01R 13/2421 439/515
6,923,690 B1 * 8/2005 Wang ..... H01R 13/2421 439/500
6,951,488 B2 * 10/2005 Hsieh ..... H01R 13/2442 439/500
6,994,576 B2 * 2/2006 Tanaka ..... H01R 13/26 200/51.1
7,077,709 B1 * 7/2006 Shin-Ting ..... H01R 13/2421 439/289
7,115,005 B2 * 10/2006 Zhu ..... H01R 12/58 439/66
7,134,878 B2 * 11/2006 Zheng ..... H01R 13/2421 439/515
7,238,045 B1 * 7/2007 Chang ..... H01M 2/1038 439/500
7,258,571 B1 * 8/2007 Chen ..... H01R 13/2442 439/289
7,278,892 B1 * 10/2007 Chien ..... H01R 13/2442 439/862
7,357,665 B1 * 4/2008 Yan ..... H01R 13/2442 439/500
7,361,060 B2 * 4/2008 Russelburg ..... H01R 13/41 439/660
7,387,541 B1 * 6/2008 Lai ..... H01R 13/2442 439/660
7,431,603 B1 * 10/2008 Szmidt ..... H01R 4/4836 439/289
7,527,532 B2 5/2009 Northey
7,575,469 B1 * 8/2009 Hung ..... H01R 13/2442 439/500
7,607,952 B2 * 10/2009 Tai ..... H01R 12/57 439/700
7,625,254 B2 * 12/2009 Zhang ..... H01R 12/57 439/500
7,628,660 B2 * 12/2009 Ma ..... H01R 12/7005 439/862
7,662,000 B2 * 2/2010 Hou ..... H01R 13/112 439/700
7,713,095 B2 * 5/2010 Yodogawa ..... H01R 13/2421 439/700
7,731,509 B1 * 6/2010 Zhang ..... H01R 12/57 439/81
7,785,150 B1 * 8/2010 Ho ..... H01R 12/57 439/627
7,803,011 B1 * 9/2010 Mai ..... H01R 13/2428 439/500
7,806,739 B2 * 10/2010 Hu ..... H01R 13/2442 439/862
7,833,069 B2 * 11/2010 Wu ..... H01R 12/57 439/500
7,871,290 B2 * 1/2011 Lou ..... H01R 13/2442 439/500
7,922,547 B2 * 4/2011 Wu ..... G06K 7/0021 439/862
7,981,539 B2 * 7/2011 Lai ..... H01R 12/716 429/158
8,047,857 B1 * 11/2011 Lu ..... H01R 12/714 439/500
8,079,875 B2 * 12/2011 Ho ..... H01R 13/2428 439/627
8,100,714 B2 * 1/2012 Zhou ..... H01R 12/7023 439/557
8,123,551 B1 * 2/2012 Liu ..... H01M 2/1022 439/500
8,192,236 B1 * 6/2012 Zhu ..... H01R 12/724 439/627
8,231,417 B2 * 7/2012 Zhu ..... H01R 12/55 439/862
8,267,725 B2 * 9/2012 Zhu ..... H01R 13/2457 439/660
8,303,347 B2 * 11/2012 Chen ..... H01R 12/707 439/660
8,303,353 B2 * 11/2012 Zhu ..... H01R 12/707 439/862
8,353,730 B1 * 1/2013 Wang ..... H01R 13/2421 439/515
8,439,713 B2 * 5/2013 Chiu ..... H01R 12/724 439/862
8,460,007 B1 * 6/2013 Xie ..... H01R 13/506 439/289
8,491,338 B1 * 7/2013 Lin ..... H01R 13/2421 439/500
8,657,607 B2 * 2/2014 Xie ..... H01R 13/187 439/38
8,657,635 B2 * 2/2014 Koyama ..... H01R 13/2428 439/500
8,672,704 B2 * 3/2014 de Bruijn ..... H01R 12/68 439/422
8,734,193 B2 * 5/2014 Tokuhara ..... H01R 12/714 439/700
8,901,920 B2 * 12/2014 Takahashi ..... G01R 1/06716 324/149
8,903,459 B2 * 12/2014 Choi ..... H04M 1/0237 455/572
8,974,246 B2 * 3/2015 Son ..... H01R 4/4809 439/500
9,219,334 B2 * 12/2015 Sakai ..... H01R 13/64
9,484,639 B1 * 11/2016 Chen ..... H01R 4/4845
9,502,844 B2 * 11/2016 Chen ..... H01R 13/2428
9,515,406 B2 * 12/2016 Yu ..... H01R 13/41
9,620,882 B2 * 4/2017 Chen ..... H01R 13/2428
2002/0048999 A1 * 4/2002 Ming-Hui ..... H01R 13/2442 439/660
2004/0121654 A1 * 6/2004 Chao ..... H01R 13/2435 439/660
2005/0042938 A1 * 2/2005 Zheng ..... H01R 13/2421 439/824
2005/0070170 A1 * 3/2005 Zhang ..... H01R 13/2428 439/700
2005/0070171 A1 * 3/2005 Zheng ..... H01R 13/627 439/700
2005/0101195 A1 * 5/2005 Zhu ..... H01R 13/2421 439/700
2007/0059976 A1 * 3/2007 Yeh ..... H01M 2/20 439/500
2007/0105407 A1 * 5/2007 Dwan ..... H01R 13/2428 439/66
2008/0153347 A1 * 6/2008 Lai ..... H01R 13/2442 439/500
2008/0286992 A1 * 11/2008 Tai ..... H01R 12/57 439/77
2009/0023331 A1 * 1/2009 Chien ..... H01R 12/707 439/500
2009/0170374 A1 * 7/2009 Chu ..... H01R 13/2442 439/627
2009/0247004 A1 * 10/2009 Lou ..... H01R 13/2442 439/500
2009/0298343 A1 * 12/2009 Wu ..... H01R 12/57 439/627
2010/0120291 A1 * 5/2010 Hu ..... H01R 13/2442 439/627
2011/0034074 A1 * 2/2011 Mai ..... H01R 13/2428 439/607.01
2012/0108111 A1 * 5/2012 Koyama ..... H01R 13/2464 439/746
2013/0263448 A1 * 10/2013 Kiryu ..... H01R 43/26 29/874
2014/0227912 A1 * 8/2014 Sakai ..... H01R 13/2428 439/700
2015/0229057 A1 * 8/2015 Chu ..... H01R 13/2428 439/700
2016/0315404 A1 * 10/2016 Zhang ..... H01R 12/7088

* cited by examiner

POWER CONNECTOR HAVING A DUAL-BEAM CONTACT

BACKGROUND OF THE INVENTION

1. Field of the Invention

The present invention relates to a battery or power connector contact, and more particularly to a contact having dual contact points.

2. Description of Related Arts

China Patent No. 204696297 (counterpart U.S. Patent Application Publication No. 2016/0315404), issued on Oct. 7, 2015, discloses a battery connector with contacts of a general construction the present invention relates to. Specifically, the disclosed contact has a bulging section to make single point contact with a battery. In large current applications, there exists risk of high temperature due to the single point contact. U.S. Pat. No. 4,773,877, issued on Sep. 27, 1988, discloses a varied contact head of a planar flat bar in an electronic tester contactor. The contact head is saw-toothed and acts to come into contact with a device to be tested.

SUMMARY OF THE INVENTION

A power connector is provided to have dual contact beams in order to avoid temperature build-up in high current applications. The power connector comprises: an insulative housing comprising an upper surface, a lower surface, and a receiving space; and a plurality of contacts accommodated in the insulative housing, each of the plurality of contacts including a contacting portion, a rear portion accommodated in a rear end of the insulative housing, and a corrugated elastic portion connecting the contacting portion and the rear portion, the contacting portion comprising a lower tongue plate extending forwardly from the corrugated elastic portion, an upper tongue plate, and a curved section connecting the lower tongue plate and the upper tongue plate; wherein the curved section has a pair of contact beams.

DETAILED DESCRIPTION OF THE PREFERRED EMBODIMENT

Figure 1:
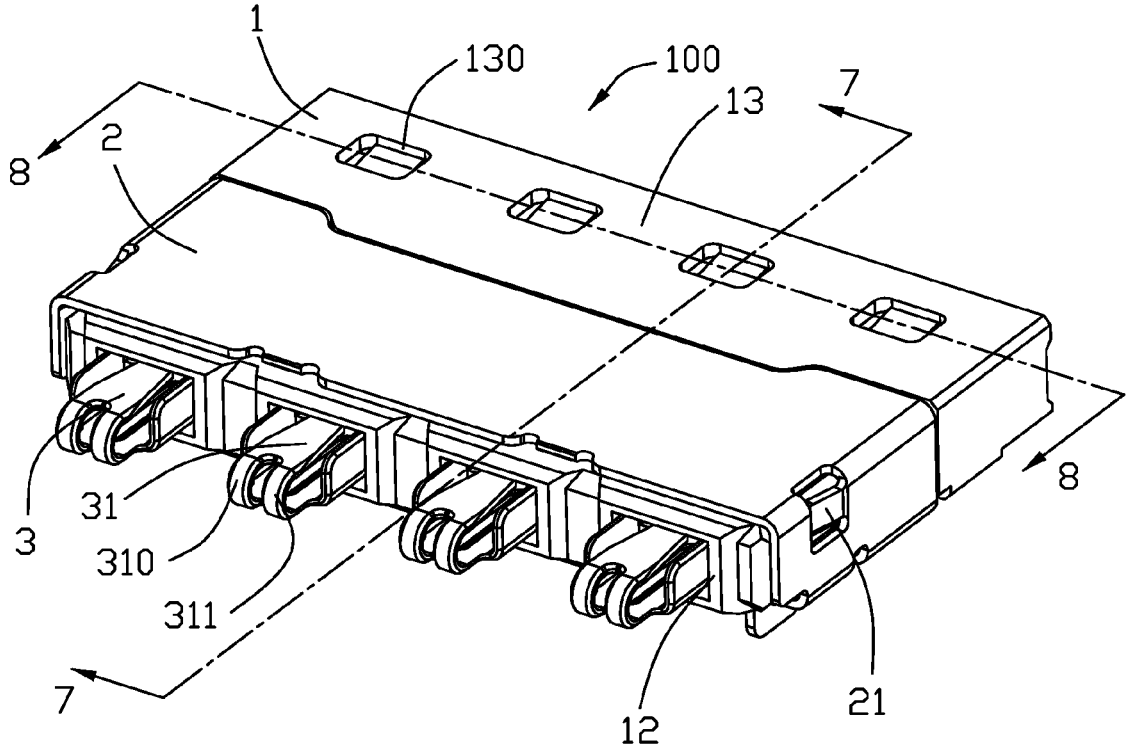
FIG. 1 is a perspective view of a power connector in accordance with the present invention.
Figure 2:
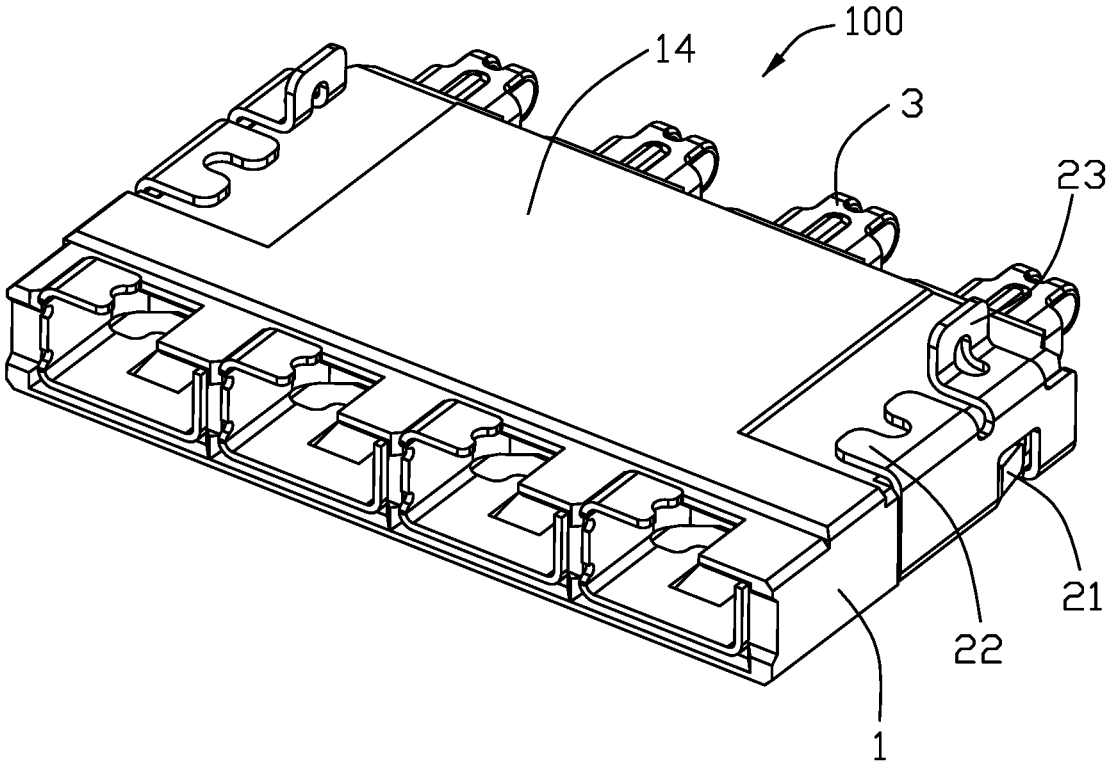
FIG. 2 is another perspective view of the power connector of FIG. 1 from an opposite perspective.

Referring to FIGS. 1 to 5, a power connector comprises an insulative housing 1, a plurality of contacts 3 respectively accommodated in the corresponding spaces/passageways 15 of the insulative housing 1, and a metallic shell 2 attached upon the housing 1.

As shown in FIGS. 4 to 8, the insulative housing 1 comprises a pair of notches 11, a front surface 12, an upper surface 13, an opposite lower surface 14, a plurality of receiving spaces/passageways 15 separated from one another by the corresponding partitions 19, and a pair of steps/recesses 16 located by two sides of each space/passageway 15. The housing 1 further has a plurality of holes 130 through the upper surface 13.

The shell 2 covers a front of the housing 1 and has a top wall 24, a pair of side walls 25 depending from the top wall, a pair of latches 21 on the side walls, a pair of securing tabs 22 extending from the corresponding side walls 25 parallel to the top wall 24 for holding the housing 1, and a pair of mounting legs 23 for mounting to a printed circuit board P (as shown in the broken lines in FIG. 7) on which the housing 1 is seated.

Figure 3:
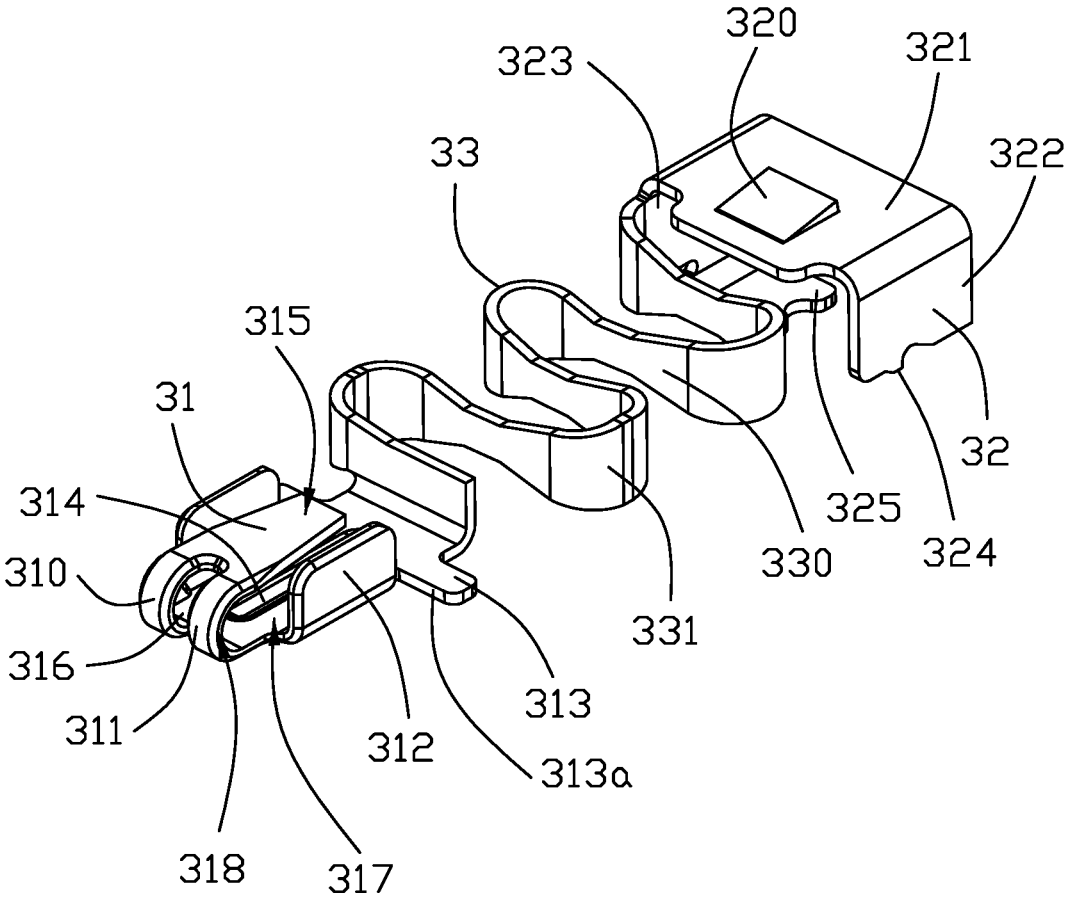
FIG. 3 is a perspective view of a contact of the power connector.
Figure 4:
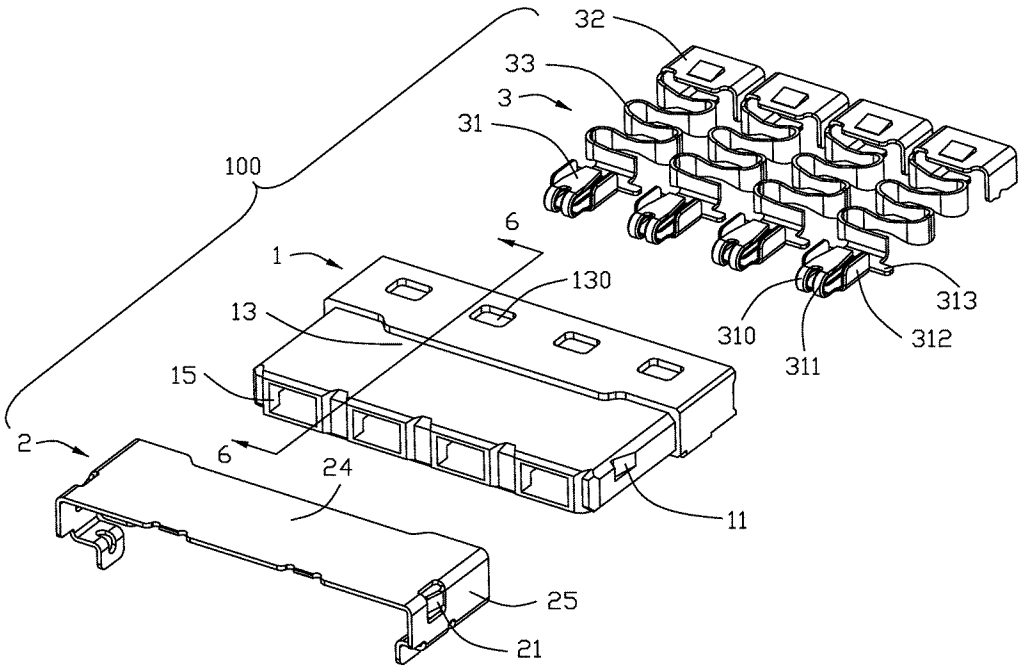
FIG. 4 is an exploded view of FIG. 1.
Figure 5:
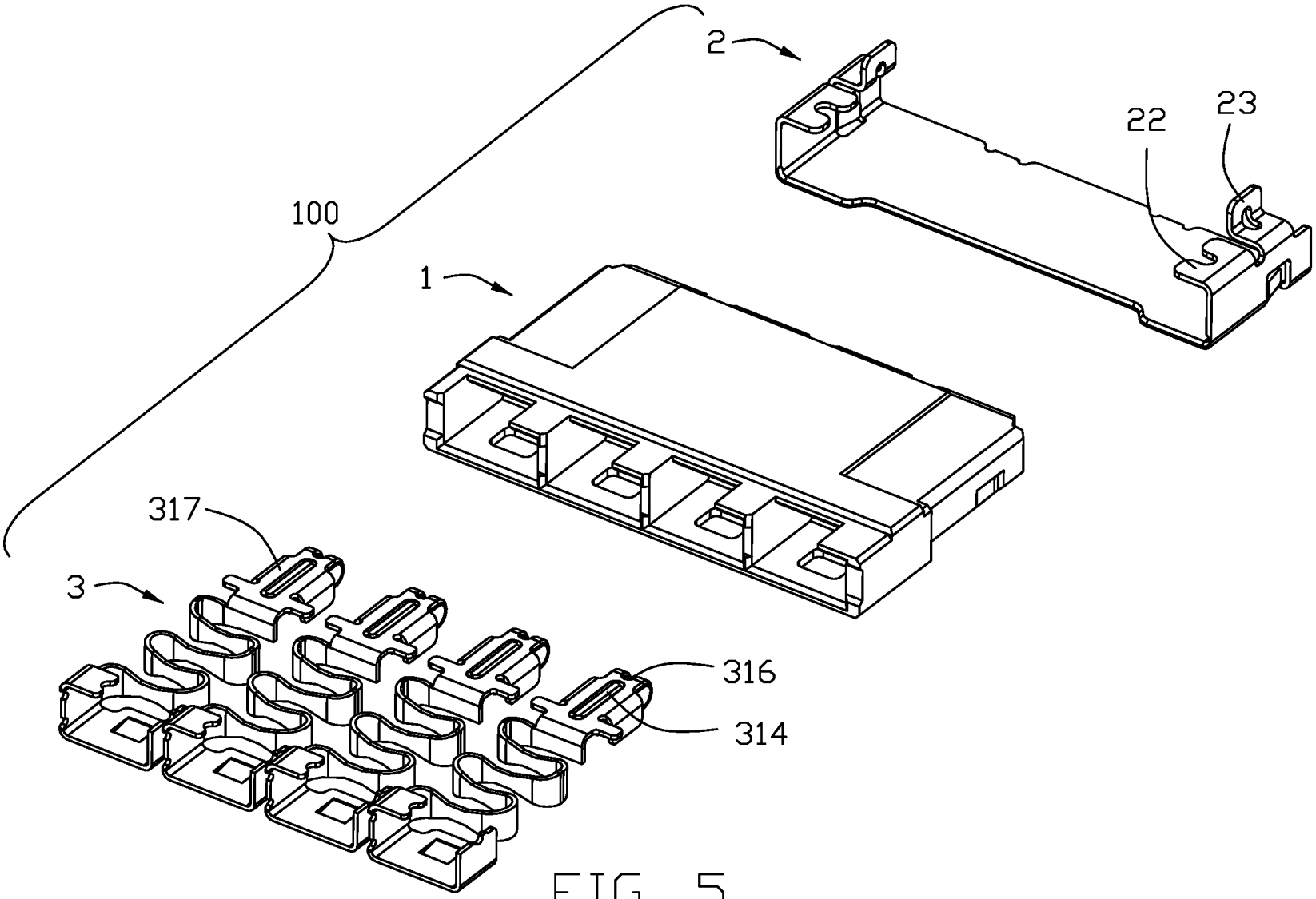
FIG. 5 is an exploded view of FIG. 2.
Figure 6:
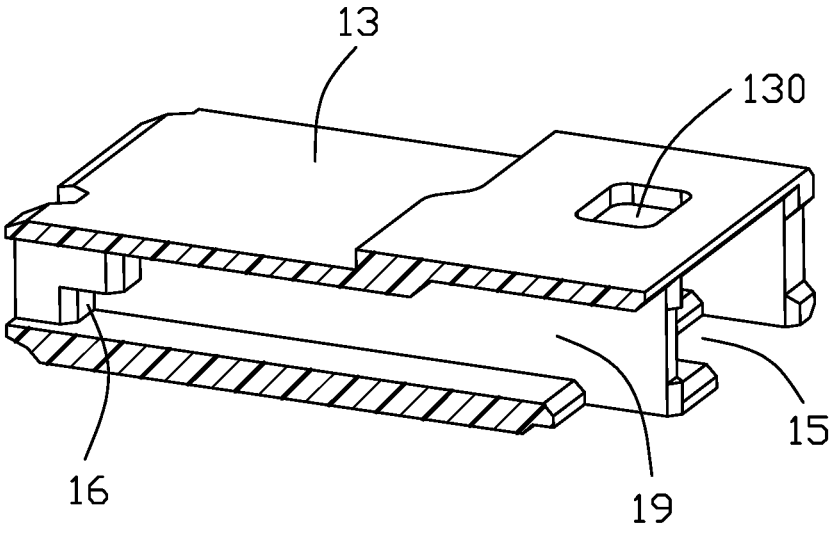
FIG. 6 is a cross-sectional view of an insulative housing of the power connector taken along line 6-6 in FIG. 4.

Referring to FIG. 3, the contact 3 comprises a front contacting portion 31 for contacting a mating connector, a rear portion 32 secured to the housing 1, and a corrugated/serpentine elastic/deformable portion 33 connecting the contacting portion 31 and the rear portion 32.

Figure 7:
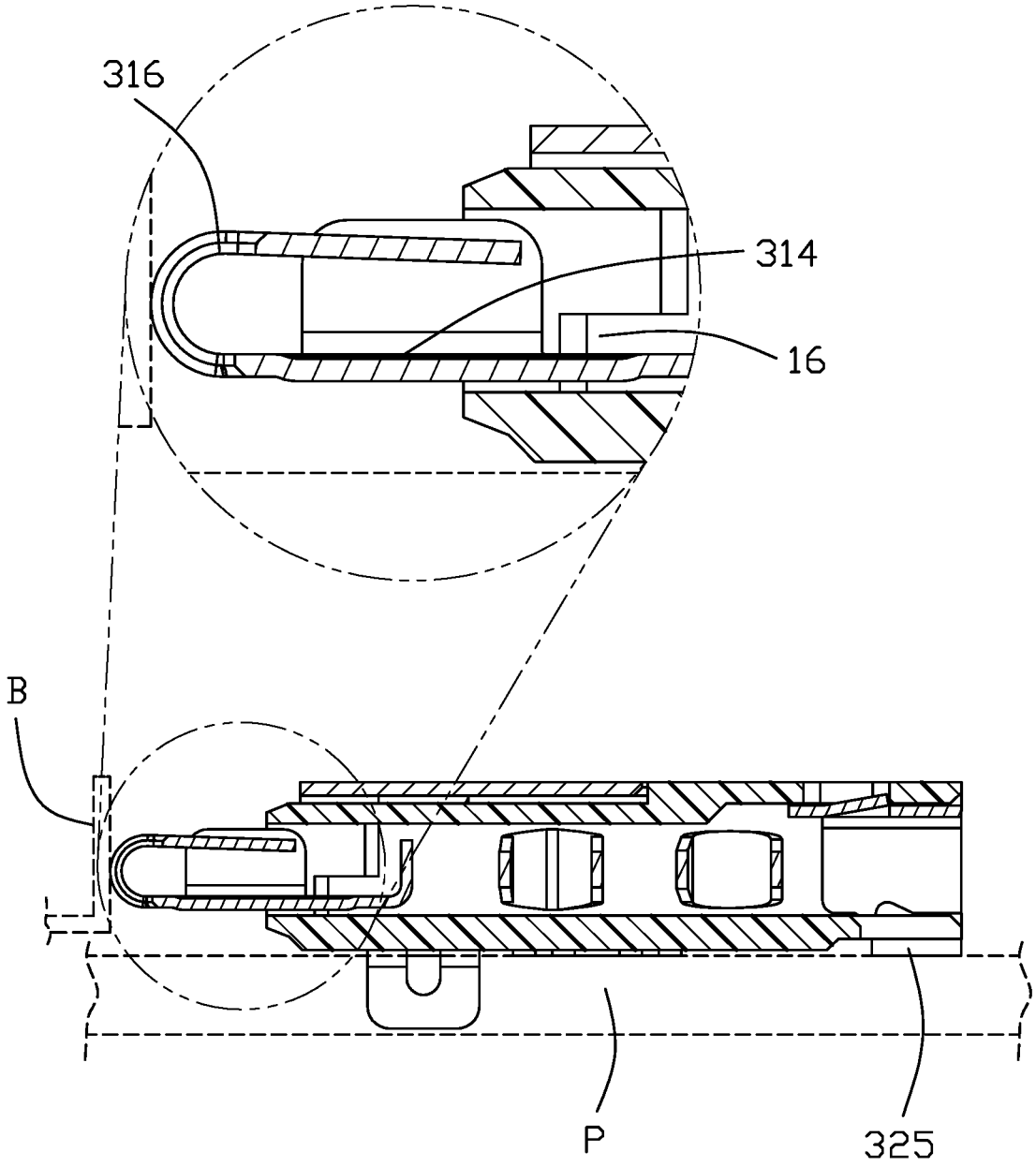
FIG. 7 is a cross-sectional view of the power connector along line 7-7 in FIG. 1.
Figure 8:
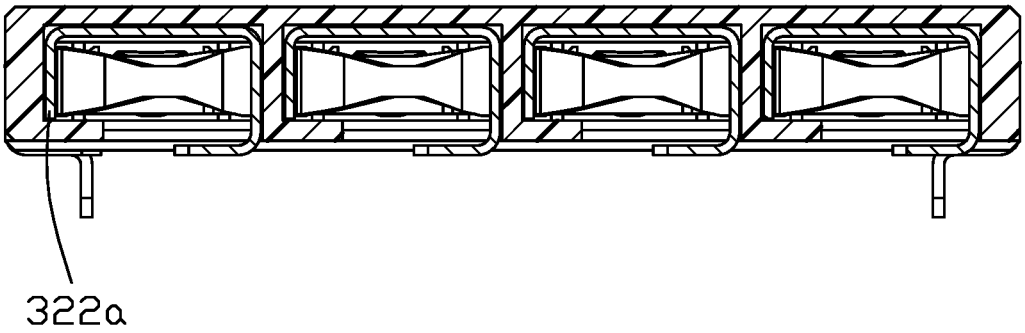
FIG. 8 is a cross-sectional view of the power connector along line 8-8 in FIG. 1.

The contacting portion 31 extends out of the housing front surface 12 for mating with a planar art of the battery B (as shown in the broken lines in FIG. 7). The contacting portion 31 is generally U-shaped and includes a lower tongue (one) plate 317 extending forwardly from the corrugated elastic portion 33, an upper tongue (the other) plate 315, and a curved or bulged section 318 connecting the lower tongue plate 317 and the upper tongue plate 315. The curved section 318 has a pair of contact beams 310 and 311. A slot 316 extending the front-to-back direction, is formed between the pair of contact beams 310 and 311, in a transverse direction perpendicular to the front-to-back direction, with opposite two ends terminated at the corresponding upper tongue plate 315 and lower tongue plate 317 around similar positions in the front-to-back direction in a side view so as to have the pair of contact beams 310, 311 operated in a balanced manner. The lower tongue plate 317 has a pair of extension portions 312, a pair of arresting portions 313, and a strengthening ridge 314 wherein the lower tongue plate 317 cooperating with the pair of extension portions 312 commonly form an upstanding U-shaped structure. Notably, the ridge 314 extends rearwardly beyond the confrontation edge 313*a* of the arresting portion 313 so as to perform stable support upon the housing 1. In this embodiment, the lower tongue plate 317 essentially intimately confronts the housing 1 in the vertical direction perpendicular to both the front-to-back direction and the transverse direction for supporting consideration while the upper tongue plate 315 is essentially spaced from the housing in the vertical direction.

The rear portion 32 is positioned at a rear of the space 15 and has a holding ramp 320. The rear portion 32 essentially forms an upside-down U-shaped structure having a main base 321 on which the holding ramp 320 is located, and a pair of side plates 322, 323 downwardly extending from two opposite side edges of the main base 321 wherein the side plate 322 includes a barb structure 324 for engagement with the housing 1 while the other side plate 323 is equipped with a horizontal solder pad 325 for mounting to the printed circuit board P.

The elastic portion 33 is positioned inside the corresponding space 15 and includes one or more bent sections 331 and one or more connecting sections 330 each connected between two adjacent bent sections. A vertical dimension of the cross-section of the bent section 331 is greater than that of the connecting section 330.

In assembly, the contact 3 is inserted into the corresponding space 15 from a rear of the insulative housing 1, with the barb structure 324 engaged with the housing 1, the arresting portion 313 engaging the step 16 and the holding ramp 320 engaging the hole 130 of the housing 1. Under such an arrangement, the elastic portion 33 is in a tensioned/preloaded/compressed manner preferably.

The shell 2 is mounted onto the housing 1 with the latches 21 engaging the notches 11.

In use, with the provision of two contact beams 310 and 311, dual contact points can be achieved while avoiding temperature build-up in high current applications. It is also because the additional slot 316 is fully empty so that the generated heat due to electrical connection may efficiently escape via the slot 316.

Figure 9:
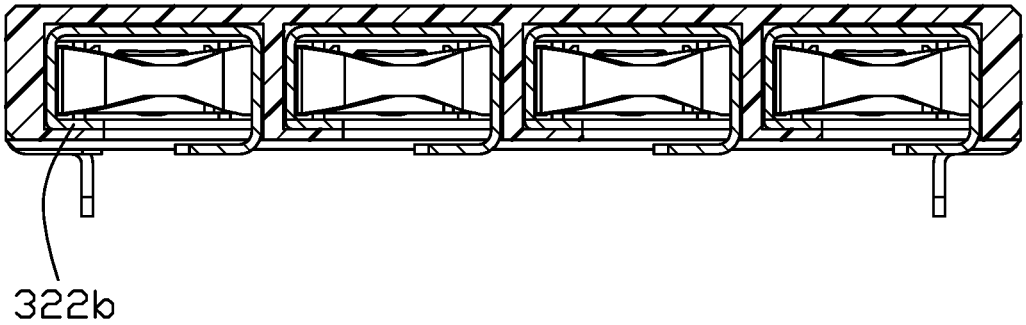
FIG. 9 is a cross-sectional view of the power connector according to another embodiment of the invention.

In the embodiment, the U-shaped rear portion 32 has the vertical side plate 322 engaged with the housing 1 via the barb structure 322*a*, the horizontal main base 321 engaged with the housing 1 via the cooperation of the holding ramp 320 and the hole 130, and another side plate 323 retained to the printed circuit board P via the solder pad 325. Anyhow, an alternate embodiment as shown in FIG. 9 may use a horizontal engaging plate 322*b* to replace the barb structure 322*a* for securely holding the rear portion 32 in position within the housing 1.

What is claimed is:

1. A power connector assembly comprising:

an insulative housing including a plurality of partitions to form corresponding passageways each extending along a front-to-back direction between two opposite front and rear ends of the housing; and a plurality of contacts disposed in the corresponding passageway, each of said contact including a contacting portion forwardly extending out of the front end of the housing and back and forth movable along the front-to-back direction, an immovable rear portion fixed around the rear end of the housing, a deformable portion connected between the contacting portion and the rear portion in said front-to-back direction; wherein said contacting portion includes, at a front end region thereof, a forwardly facing bulged section, and said bulged section defines a slot extending along a front-to-back direction so as to form two parallel contact beams located by two sides of the slot in a transverse direction perpendicular to said front-to-back direction; and said contacting portion is essentially of a lying U-shaped structure including a lower tongue plate and an upper tongue plate with said bulged section connected therebetween, and one of said lower tongue plate and said upper tongue plate is supported by the housing in a vertical direction perpendicular to both the front-to-back direction and the transverse direction while the other is spaced from the housing in the vertical direction for free movement.

2. The power connector assembly as claimed in claim 1, wherein said slot includes two opposite ends terminated at similar positions along the front-to-back direction in a side view.

3. The power connector assembly as claimed in claim 1, wherein said one of said lower tongue plate and said upper tongue plate is connected to the deformable portion while the other of said lower tongue plate and said upper tongue plate has a rearwardly directing free end.

4. The power connector assembly as claimed in claim 3, wherein said one of said lower tongue plate and said upper tongue plate is equipped with a strengthening ridge extending along the front-to-back direction.

5. The power connector assembly as claimed in claim 4, wherein said strengthening ridge extends rearwardly beyond the slot in the front-to-back direction.

6. The power connector assembly as claimed in claim 3, wherein said one of the lower tongue plate and said upper tongue plate further includes a pair of arresting portions abutting against corresponding steps of the housing for preventing further forward movement of the contact.

7. The power connector assembly as claimed in claim 6, wherein said one of said lower tongue plate and said upper tongue plate is equipped with a strengthening ridge extending along the front-to-back direction, and said strengthening ridge extends is aligned with the slot in the front-to-back direction.

8. The power connector assembly as claimed in claim 7, wherein said strengthening ridge extends rearwardly beyond a forwardly facing confrontation edge of each of said arresting portions.

9. The power connector assembly as claimed in claim 3, wherein said one of the lower tongue plate and said upper tongue plate further includes a pair of extension portions to commonly form a U-shaped structure viewed along the front-to-back direction.

10. The power connector assembly as claimed in claim 1, wherein the rear portion forms an upside-down U-shaped structure including a horizontal main base with a holding ramp engaged within a hole for preventing rearward movement of the contact, a pair of side plates extending downwardly from two opposite side edges of the main base, one of said side plates equipped with an engaging structure for engagement with the housing while the other of said side plates being equipped with a horizontal solder pad.

11. The power connector assembly as claimed in claim 10, wherein said engaging structure is either a barb structure or an engaging plate.

12. The power connector assembly as claimed in claim 1, wherein said contacting portion is configured to be mated with a planar part of a battery in a head-to-head manner so as to have the slot fully empty during mating for heat transfer consideration.

13. A power connector comprising:

an insulative housing including a plurality of partitions to form corresponding passageways each extending along a front-to-back direction between two opposite front and rear ends of the housing; and a plurality of contacts disposed in the corresponding passageways, each of said contacts including a contacting portion forwardly extending out of the front end of the housing and back and forth movable along the front-to-back direction, an immovable rear portion fixed around the rear end of the housing, a deformable portion connected between the contacting portion and the rear portion in said front-to-back direction; wherein the rear portion forms an upside-down U-shaped structure including a horizontal main base with a holding ramp engaged within a hole for preventing rearward movement of the contact and a pair of side plates extending downwardly from two opposite side edges of the main base in a vertical direction perpendicular to said front-to-back direction, one of said side plates equipped with an engaging structure for engagement with the housing while the other of said side plates being equipped with a horizontal solder pad; and the contacting portion includes an upstanding U-shaped structure with a pair of upwardly extending extension portions for stabilizing the contacting portion, and further a pair of arresting portions behind said pair of upwardly extending extension portions for preventing further forward movement of the contact.

14. The power connector as claimed in claim 13, wherein said contacting portion defines two parallel contact beams isolated from each other via a slot therebetween in a transverse direction perpendicular to both said front-to-back direction and said vertical direction.

15. The power connector as claimed in claim 14, wherein the upstanding U-shaped structure further includes a strengthening ridge extending along the front-to-back direction in alignment with the slot.

16. A power connector comprising:

an insulative housing including a plurality of partitions to form corresponding passageways each extending along a front-to-back direction between two opposite front and rear ends of the housing; and a plurality of contacts disposed in the corresponding passageway, each of said contact including a contacting portion forwardly extending out of the front end of the housing and back and forth movable along the front-to-back direction, an immovable rear portion fixed around the rear end of the housing, a deformable portion connected between the contacting portion and the rear portion in said front-to-back direction; wherein the rear portion forms an upside-down U-shaped structure including a horizontal main base with a holding ramp engaged within a hole for preventing rearward movement of the contact, a pair of side plates extending downwardly from two opposite side edges of the main base in a vertical direction perpendicular to said front-to-back direction, one of said side plates equipped with an engaging structure for engagement with the housing while the other of said side plates being equipped with a horizontal solder pad;

said contacting portion defines two parallel contact beams isolated from each other via a slot therebetween in a transverse direction perpendicular to both said front-to-back direction and said vertical direction; and the contacting portion includes an upstanding U-shaped structure having a strengthening ridge extending along the front-to-back direction in alignment with the slot.

* * * * *